United States Patent [19]

Guendulain

[11] 4,170,730

[45] Oct. 9, 1979

[54] MULTIPLE MODULAR SWITCH AND WALL PLUG

[76] Inventor: Ramon P. Guendulain, Giorgioni 31-G, Mixcoac, 19 Mexico City, Mexico

[21] Appl. No.: 820,070

[22] Filed: Jul. 28, 1977

[51] Int. Cl.[2] ..... H01H 23/20

[52] U.S. Cl. ..... 200/67 F; 200/244; 200/322; 335/205; 335/206

[58] Field of Search ..... 200/244, 318, 322, 67 F; 335/205, 206, 207; 220/23.4

[56] References Cited

U.S. PATENT DOCUMENTS

| | | | |
|---|---|---|---|
| 2,971,068 | 2/1961 | Wegner | 200/67 F |
| 2,975,930 | 3/1961 | Pennington et al. | 220/23.4 |
| 3,194,912 | 7/1965 | Mink | 200/67 F |
| 3,673,358 | 6/1972 | Harmon | 335/206 X |
| 3,743,980 | 7/1973 | Steiner | 335/205 |

FOREIGN PATENT DOCUMENTS

| | | | |
|---|---|---|---|
| 1329674 | 4/1902 | France | 335/205 |
| 1319470 | 9/1963 | France | 200/67 F |

*Primary Examiner*—Joseph Man-Fu Moy
*Attorney, Agent, or Firm*—Ladas, Parry, Von Gehr, Goldsmith & Deschamps

[57] ABSTRACT

A modular electric switch or wall socket comprises a pair of electrodes or screws inserted into a case to which are connected the terminals of electric current of the circuit it is desired to control, and a rockable block which actuates the breaking or connecting of the circuit. The case is a solid insulating box having a recess in its upper face and a slot inside the recess and forming steps with the bottom surface of the recess. On the steps are mounted two plates bent at right angles and placed opposite and facing each other in such a way that the vertical portions of these angular plates which are inserted into the inside of the slot bear firmly against and establish electrical contact with two posts inserted in the corresponding opposite sides of the walls of the case, to which posts the terminals of the electric circuit are connected. One of the angular plates is pivotally connected to the tips of an electrically conducting strip which is held by means of a screw to a recess on the underside of the rockable control block.

10 Claims, 8 Drawing Figures

MULTIPLE MODULAR SWITCH AND WALL PLUG

BACKGROUND OF THE INVENTION

This invention refers in general to switches, wall sockets and electrical accessories and more particularly concerns improvements in multiple modular switches and wall sockets which do not require springs for their functioning.

Up to the present time the switches for house circuits and the like have been made up of a plurality of parts subject to wear and to mechanical failure, or else have had a relatively high cost because of the need for specialized manual labor permitting the assembly of every one of their parts which, because of including springs, involved difficulties in the assembly operation. Furthermore conventional switches include electrically conductive parts which in the event of a failure may present the dangers of a short circuit or of electrical discharges which are both undesirable and dangerous to the users.

SUMMARY OF THE INVENTION

In view of the foregoing it is an object of the present invention to provide a modular switch and electrical socket which do not require springs for their functioning and which therefore assure long functioning life with no danger of parts wearing out or of mechanical failure, and which furthermore permit of simpler and easier assembly that conventional switches.

In addition the improved modular switch and wall socket of the present invention employs all insulating parts except the electrodes, and in this way obviates the dangers of a short circuit or an undesirable electrical discharge.

The improved switch and wall socket of the present invention are made up of an insulating case with a recess in its upper wall which constitutes a space to receive an insulating block which is the actuating button as such of the switch. The said case has within the first recess a second recess or depression in which are placed two plates bent at right angles facing each other and spaced apart supported on a step formed by a central slot formed in the second recess, which slot extends almost to the bottom of the case. The vertical portions of these angular facing plates touch or make electrical contact with two electrodes or electrically conducting screws which project slightly from the respective opposite facing walls of the slot in the case in which they are substantially embedded excepting for recesses that permit connecting the respective ends of the electrical leads to the screws.

In the electrical wall socket a panel is simply installed by pressure or secured in any manner firmly to the first recess in the upper end of the case, and there are slots extending practically the whole length of the panel which permit of connecting one or several electrical connections in such a way that the electrodes or tips of the plug make contact respectively with the angular plates above mentioned.

In the case of the switch, one of the angular plates has on each of its sides a bracket projecting upward and having a hole to receive a pivot or rod upon which can pivot the diametrically opposed side tips of a strip inserted into a recess in the block. The strip between the two downwardly projecting tips includes a magnetic body, and by means thereof the block or actuating key of the switch will have the two fixed positions of off and on by reason of the magnetic attraction for the angular plates exerted by the magnetic body. The user will thus be able by means of a mere light pressure on the block to change the position of the block. The mounting of the angular plates and of the strip in the block can be effected in any manner including magnetic mounting.

The cases which make up the switch and the wall socket, although essentially they are modules which can be used for either one or the other application, can be integrally made to provide a multiple case for two or more sockets and switches or combinations thereof.

The connecting cases for the improved switches and sockets of this invention include a slotted pin having its two tips slightly spread apart in such a way as to permit its insertion in a solid manner by pressure into a sleeve of suitable diameter inserted into another box having bottom and side walls and having its upper portion open and having elongated slots in its sidewalls in such a way that they can admit a connecting sleeve with peripheral slots in its ends to permit a similar box to be connected to it by sliding it thereonto, in order to increase the number of sockets and switches depending on the requirements of the user.

These and other objects to be obtained through the practice of this invention will be better understood and more fully appreciated in reading the following description which makes reference to the accompanying drawings of the preferred embodiment of the invention.

DETAILED DESCRIPTION OF THE INVENTION

Figure 1:
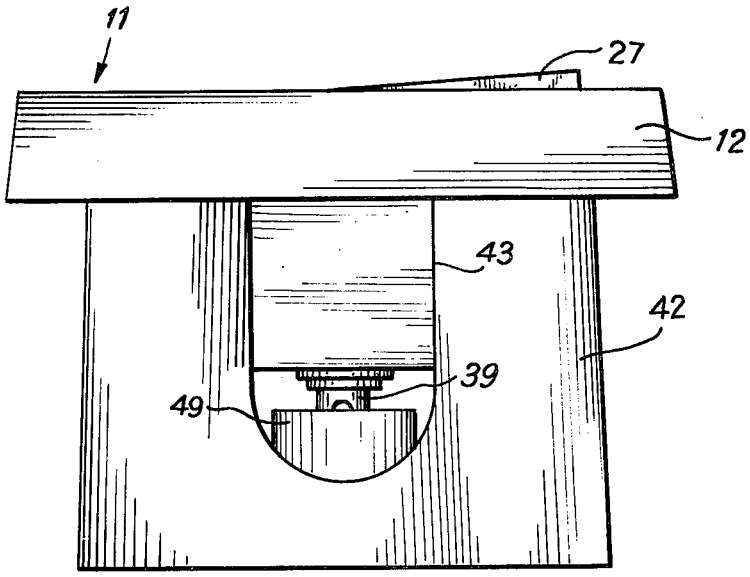
FIG. 1 is a view in vertical elevation of the improved modular switch of the present invention.
Figure 2:
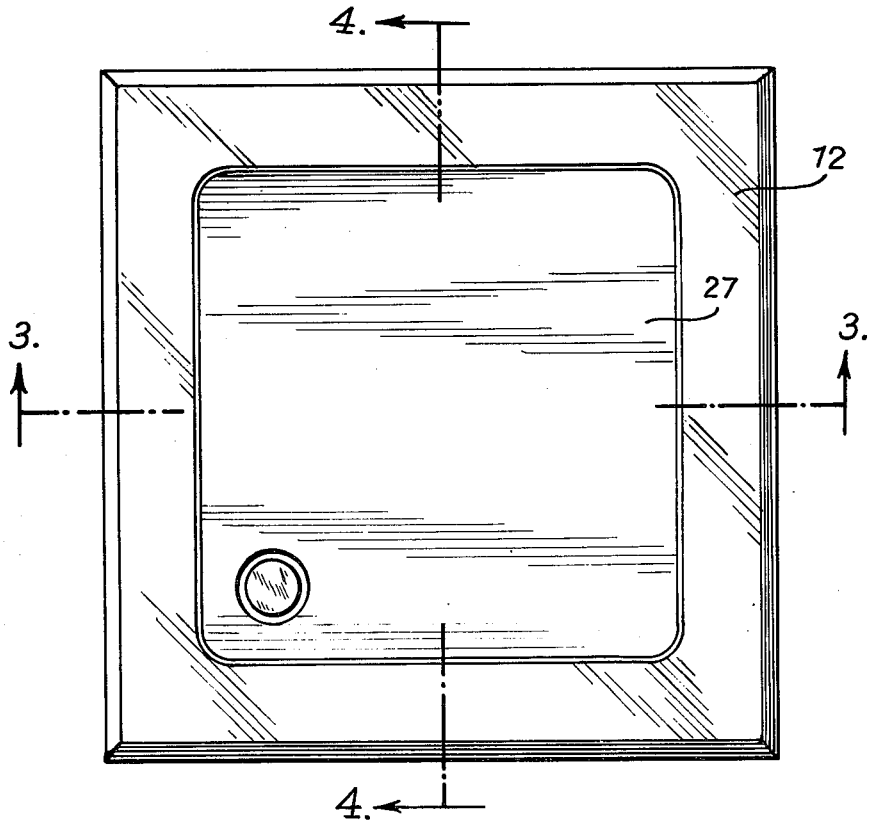
FIG. 2 is an upper plan view of the improved switch of the present invention shown in FIG. 1.

The improved switch of this invention 11 comprises a solid insulating case 12 having a first recess 13 and inside the latter a second recess 14 which in turn has a central slot 15 extending almost to the bottom 16 of the case. At the juncture of the second recess 14 and the middle slot 15 steps 10 are formed and upon these electrically conductive plates 17 and 18 are placed and are secured to the case 12 by means of magnetic inserts 19. The vertical parts of plates 17 and 18 which are inserted into slot 15 bear with one surface against the respective ends of two posts or screws 20; the latter are so placed that they do not project beyond the outer face of case 12 and each one of them is connected to respective terminal 21 of the electrical leads.

Figure 3:
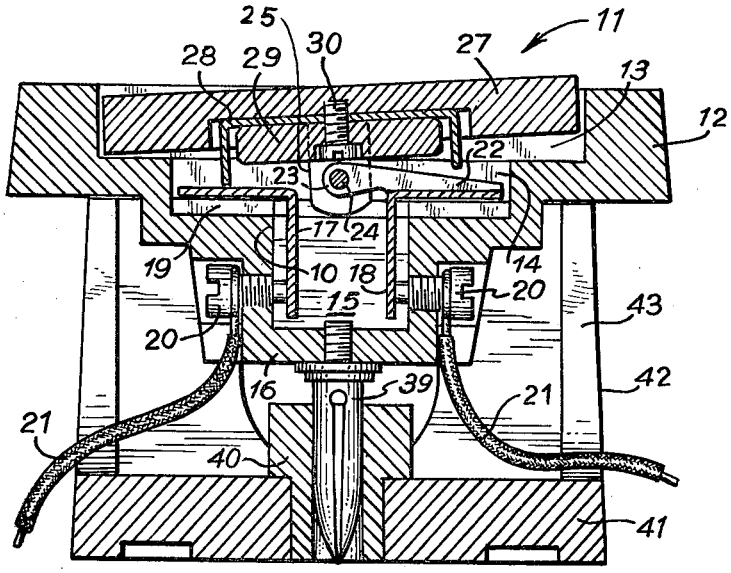
FIG. 3 is a view in cross-section along lines 3—3 of FIG. 2.
Figure 4:
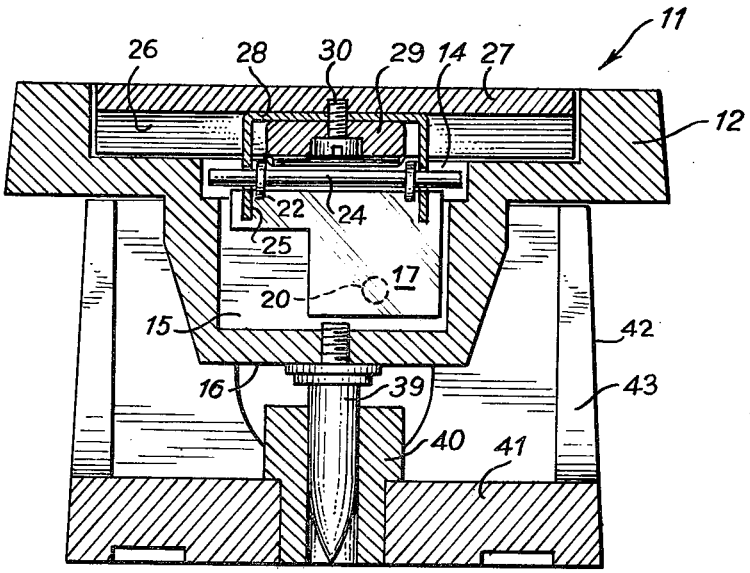
FIG. 4 is a view in cross-section along lines 4—4 of FIG. 2.

In the case of the switches, as is shown in the drawings, and particulary in FIG. 3, one of the angular plates 18 has extending upward from its sides a pair of brackets 22 having a hole 23 in the end thereof in which is carried a pivot pin 24 to which are rockingly attached the tips 25 of an electrically conductive strip 28. The strip 28 is secured to an actuating block or key 27 and is deposed in a recess 26 in the inside face thereof. The block 27 is so accomodated in the first recess 13 of the case that it can alternate between two positions, the on or closed position shown in FIG. 3 and the open or off position.

In FIG. 3 the electric circuit is shown closed, allowing electricity to pass from one of the electrical conductors 21 to screw 20 to one of the angular plates 18, to the brackets 22 thereof, to pivot 24, to tips 25, to strip 28, to other angular plate 17, to other screw 20, and other electrical lead 21. To fix the position of on or off of block 27 a magnet or magnetic body 29 is used, held merely by magnetism to strip 28 or otherwise with a screw 30. Because of the magnetic attraction between this magnetic body and angular plates 17 and 18, only a light pressure on the block will be needed in order to displace it to the on or off position respectively.

Figure 5:
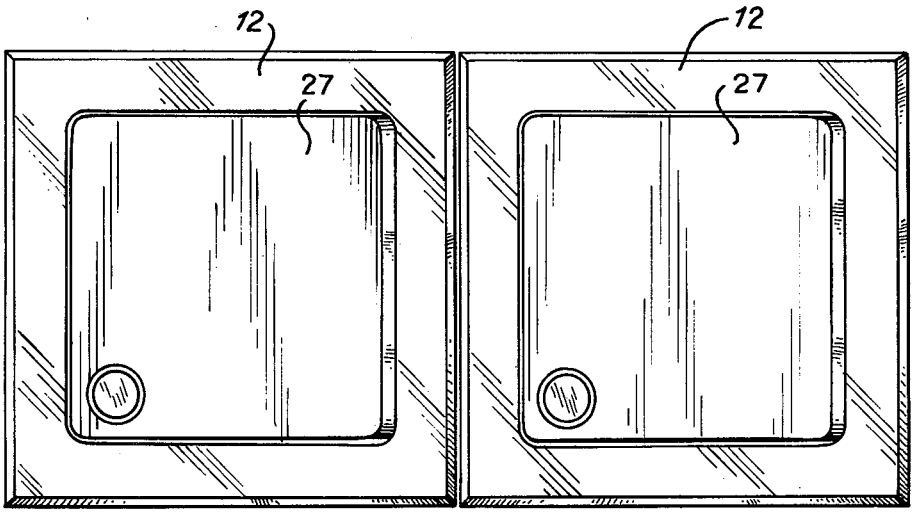
FIG. 5 is an upper plan view showing the connection of two improved switches of the present invention such as shown in FIG. 1.
Figure 6:
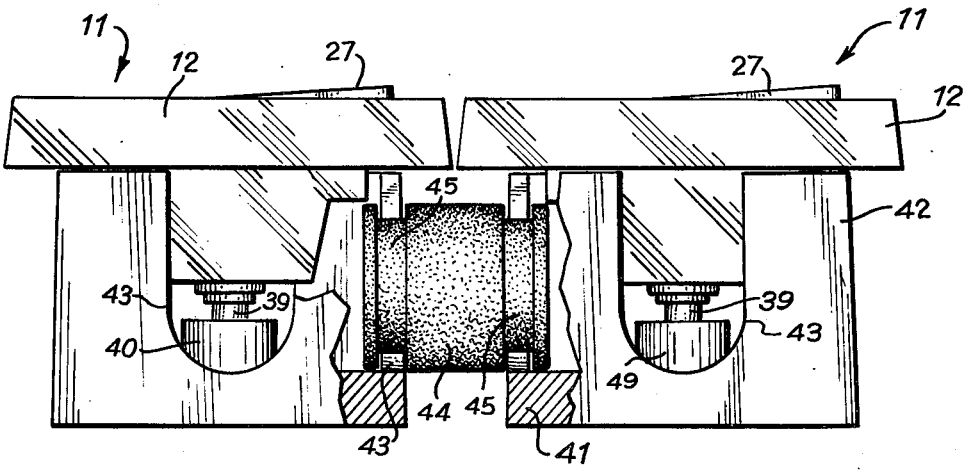
FIG. 6 is a view in side elevation of the switches shown in FIG. 5 with a conventional cutaway to show the connection between them.
Figure 7:
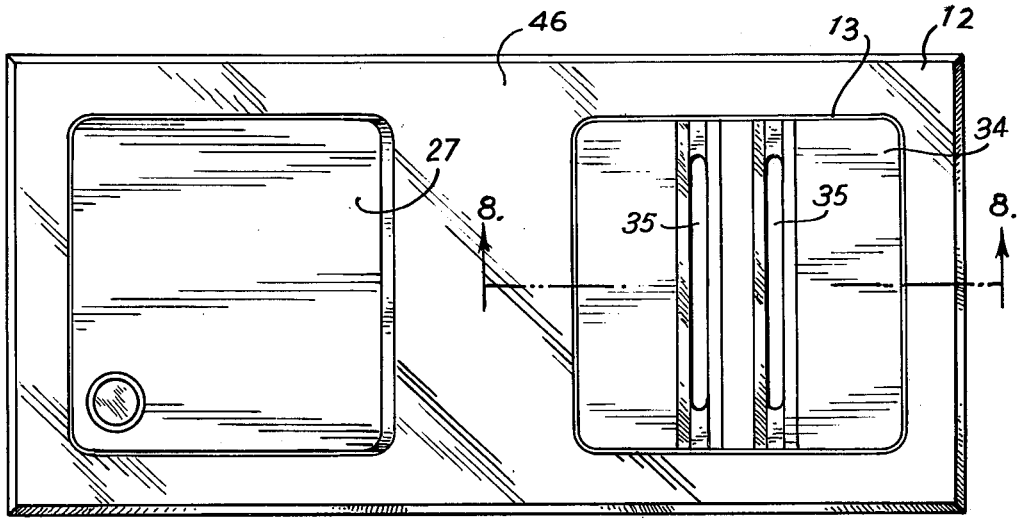
FIG. 7 is an upper plan view showing a switch similar to the one shown in FIG. 1 coupled to a wall socket having long slots to permit of connecting multiple plug-ins.
Figure 8:
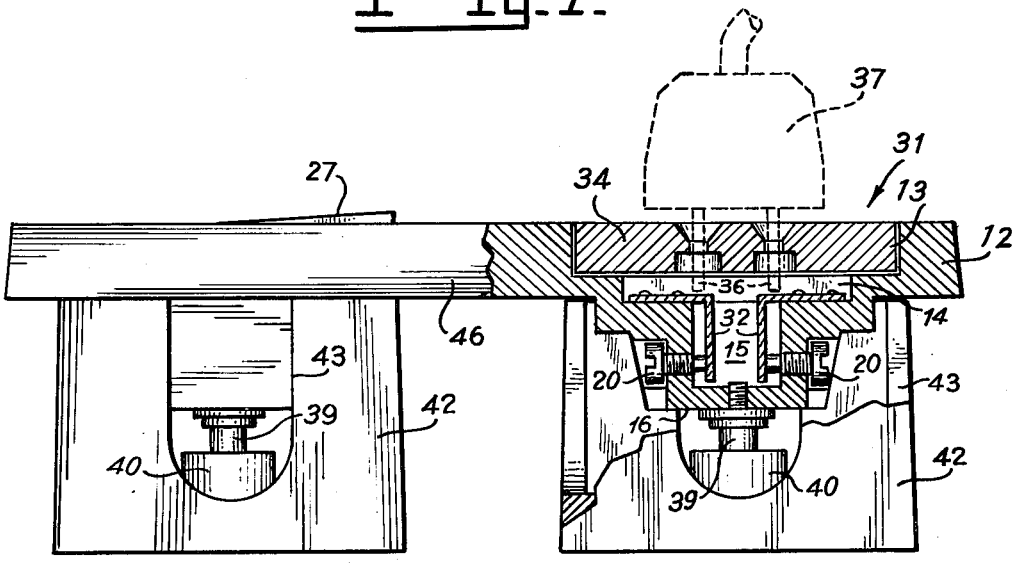
FIG. 8 is a view in elevation of the switch and wall socket shown in FIG. 7, with a conventional cutaway view along 8—8 of FIG. 7, showing the internal parts making up the improved electrical wall socket of the present invention.

In the event the same module is used as a contact or wall socket 31 (FIGS. 7 and 8), angular plates 32 will have no bracket, and first recess 13 will receive directly and under pressure a panel 34 having elongated parallel slots 35 spaced apart and so disposed that when the contact points 36 of a plug 37 are inserted electrical contact is assured between contact points 36 and angular plates 32. Because of the length of slots 35 it is possible to connect two or more plugs 37. The modular cases 12 of the switches 11 and of the electrical sockets 31 have a pin or rod 39 projecting from their lower end, firmly secured thereto and split in such a manner as to permit its insertion by pressure into a sleeve 40 inserted into the bottom wall 41 of an insulating box; the latter also has side walls 42 provided with elongated slots 43 extending from the upper edge of the box to the bottom thereof, which slots by means of sleeve 44 (FIG. 6) which has peripheral end grooves 45 permit of connecting together two of these switches 11 to form a double switch, like the one illustrated in FIG. 5. Naturally the integration of modular boxes can consist of a double case in accordance with the embodiment of FIGS. 7 and 8, where said cases are connected by an intermediate integral portion 46.

While the foregoing description has been made in reference to a specific embodiment of the invention, it will be understood by all persons expert in this subject matter that any change in form or detail will be encompassed within the scope and spirit of this invention.

I claim:

1. An electric switch comprising a mounting plate formed with a recess having a bottom surface and with a slot having walls extending downwardly from the bottom surface of the recess, the opposing walls of the slot forming respective steps with the bottom surface of the recess, first and second terminal connection posts projecting into the slot from said opposing walls respectively, and first and second angled plates of electrically conductive material mounted over said steps respectively and each having one portion overlying the bottom surface of the recess and another portion extending into the slot, the other portions of said angled plates being in electrically conductive contact with said terminal connection posts respectively, said first angled plate being formed with two parallel bracket portions projecting from its said one portion in the direction away from said bottom surface of the recess, and the switch further comprising a control block, an electrically conductive connection member secured to the control block and pivotally connected to said bracket portions of the first angled plate whereby the control block is mounted in said recess of the mounting plate so as to be rockable between a first position in which the connection member engages the second angled plate and a second position in which the connection member is electrically insulated from the second angled plate, and magnetic biasing means effective to retain the control block in one of the first and second positions until sufficient force tending to rock the control block to the other position is applied to the control block to overcome the magnetic retaining force exerted by the magnetic biasing means, whereupon the control block rocks to said other position and is retained in that position by the magnetic biasing means until sufficient force tending to rock the control block to said one position is applied to the control block to overcome the magnetic retaining force exerted by the magnetic biasing means, whereupon the control block rocks to said one position.

2. A switch as claimed in claim 1, wherein said recess is made up of a first recess portion extending from a front surface of the mounting plate and having a base, and a second recess portion extending from the base of the first recess portion and having a base constituting said bottom surface, said second recess portion having side walls which form a step with the base of said first recess portion.

3. A switch as claimed in claim 1, wherein the walls of said slot extend perpendicularly to said bottom surface of the recess, and said one portion and said other portion of each of said first and second plates are at right angles to each other, said other portions of said plates confronting each other across said slot.

4. A switch as claimed in claim 1, wherein said bracket portions are formed with respective openings through which a pivot pin extends, said connection member being mounted on the pivot pin.

5. A switch as claimed in claim 1, wherein said magnetic biasing means include a magnet secured to the control block.

6. A switch as claimed in claim 5, wherein the magnet is secured to the control block by virtue of magnetic attraction forces.

7. A switch as claimed in claim 5, wherein the magnet is secured to the control block by means of a screw or the like.

8. A switch as claimed in claim 1, further comprising a box to which said mounting plate is secured, said box having a bottom wall and having side walls extending from the bottom wall and terminating in a rim of the box, the mounting plate being secured to the box in engagement with the rim thereof.

9. A switch as claimed in claim 8, further comprising a sleeve secured at the bottom wall of the box and defining a bore, and a split pin secured to the mounting plate and received with pressure fit in said bore.

10. A switch as claimed in claim 8, wherein at least one of the side walls is formed with an elongated slit, and the switch further comprises a connecting sleeve which is formed at each end with a peripheral groove, the external diameter of the grooved portions of the connecting sleeve being substantially equal to the width of the slot and other portions of the sleeve being of external diameter greater than the width of the slot.

* * * * *